United States Patent [19]

Brandon et al.

[11] Patent Number: 4,990,938

[45] Date of Patent: Feb. 5, 1991

[54] PRINTER NEST FOR POSITIONING INK JET PRINT/CARTRIDGE

[75] Inventors: John M. Brandon, Beavercreek; Richard J. Ratermann, Centerville; Michael A. Walters, Kettering; David P. Schenck, Miamisburg, all of Ohio

[73] Assignee: Eastman Kodak Company, Rochester, N.Y.

[21] Appl. No.: 445,825

[22] Filed: Dec. 4, 1989

[51] Int. Cl.[5] ..... B41J 2/175; B41J 2/05

[52] U.S. Cl. ..... 346/140 R

[58] Field of Search ..... 346/140 R, 75; 400/126, 400/175

[56] References Cited

U.S. PATENT DOCUMENTS 4,736,213 4/1988 Piatt et al. ..... 346/140 R 4,755,836 7/1988 Ta et al. ..... 346/140 R

*Primary Examiner*—Bruce A. Reynolds

*Assistant Examiner*—Victor DeVito

*Attorney, Agent, or Firm*—John D. Husser

[57] ABSTRACT

An improved nest device construction for use with insertable ink jet print/cartridges having detent portions accurately located vis a vis their orifice array. The construction includes a U-shaped member, having a handle and arms spaced to receive a print/cartridge, which is mounted on a printer carriage for rotation between insert and retain positions. The arms have interior pinch surfaces for slidably engaging an inserted print/cartridge during rotation of said member and a bottom lip edge that extends inwardly to initially support a print/cartridge in an insert position. A spring is located between the arms of the member to contact the bottom rear surface of an inserted print/cartridge and tilt its front face into engagement with a positioning knife edge.

5 Claims, 3 Drawing Sheets

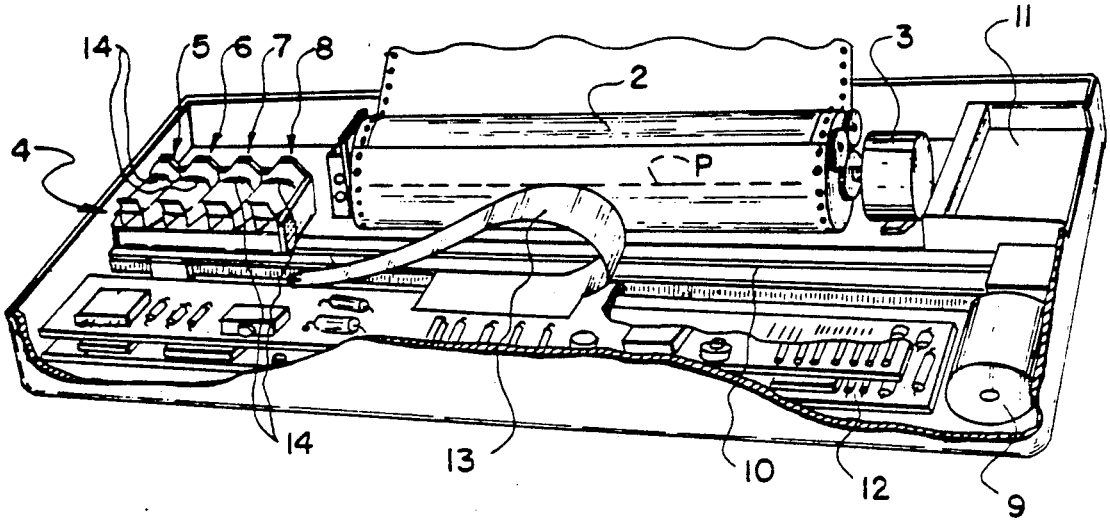
FIG. 1
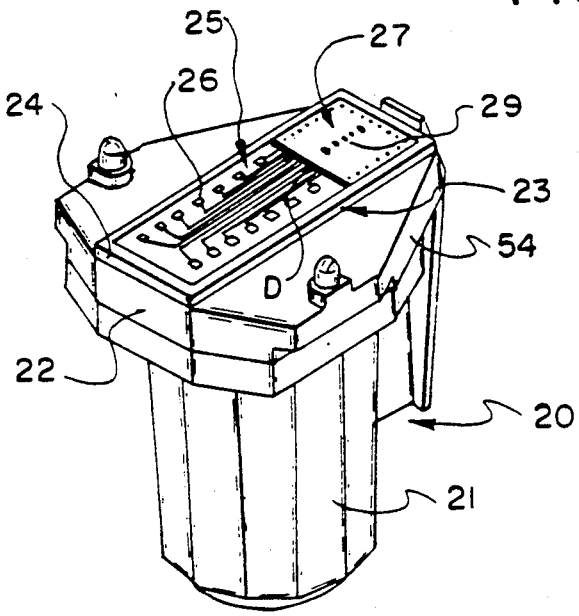
FIG. 2
FIG. 3
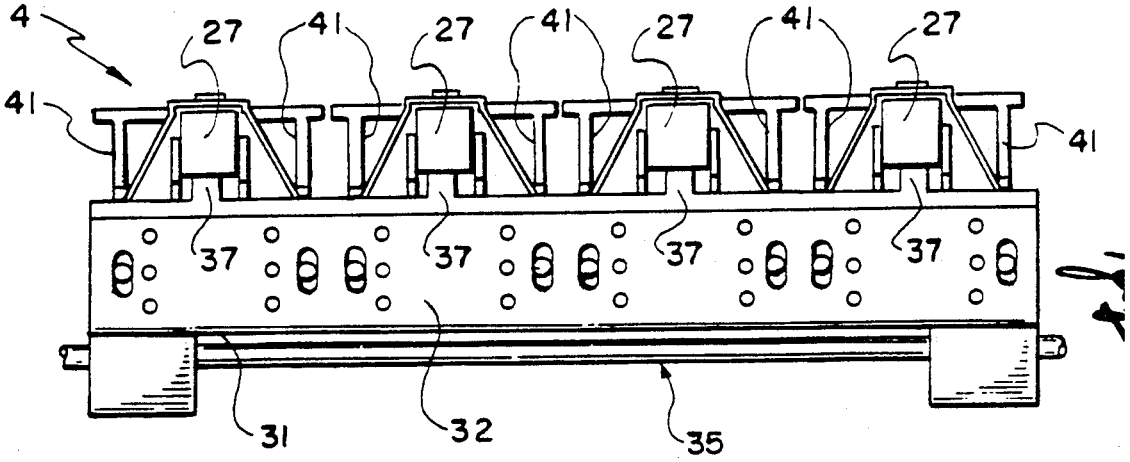

PRINTER NEST FOR POSITIONING INK JET PRINT/CARTRIDGE

FIELD OF THE INVENTION

The present invention relates to ink jet printers of the kind using insertable print/cartridges and, more particularly, to improved printer nest constructions for accurately positioning such print/cartridges for printing operations.

BACKGROUND ART

U.S. Pat. No. 4,736,213 discloses an ink jet printer having a carriage assembly that includes novel nest constructions for insertably positioning a plurality of print/cartridges in accurate vertical interrelations. The nest constructions comprise a knife edge reference surface for cooperating with a detent structure on the print/cartridge orifice plate and indexing means for moving an inserted print/cartridge so that the reference surface and detent structure achieve precise aligning engagement. In one embodiment the indexing means includes camming structures which: (i) force a lower region of the print/cartridge face into contact with the knife-edge, (ii) then move the print/cartridge down until aligning engagement is effected and (iii) then move a bottom portion of the print/cartridge face into proper electrical contact with printer terminals.

While the constructions of the '213 patent perform well, they require fairly accurate motions to assure that the proper engagement occurs between the print/cartridge and printer reference surface. This, in turn, requires accurate fabrication of the indexing parts of the printer nest. Also, the structural approach of the '213 patent results in certain printer nest portions residing in fairly high stress conditions at their indexing position, which, in molded plastic embodiments, can lead to a permanent set in the plastic and loss of their holding force.

SUMMARY OF THE INVENTION

One important aspect of the present invention is to provide an improved printer nest construction which avoids the above noted disadvantages of prior print/cartridge nest constructions. Thus, one advantage of the present invention is that its nest construction provides a more simple way to obtain reliable engagement between the printer referencing surface and the detent portion of print/cartridges. Another advantage of the present invention is that the holding structure of its nest construction is much less subject to permanent sets in the nest material. Another advantage of the present invention is its simplicity of fabrication.

In one preferred embodiment the present invention constitutes an improved nest device for an ink jet printing apparatus having a carriage using insertable print/cartridges. The nest device includes a U-shaped member that has arms spaced to receive a print/cartridge therebetween and is mounted on the carriage for rotation, on an axis extending through central regions of the arms, between insert and an index positions. The arms have interior pinch surfaces for slidably engaging an inserted print/cartridge during rotation of the member and a bottom ledge portions that extends inwardly to initially support a print/cartridge in an insert position. Spring means located between the arms of the member contact the bottom rear surface of an inserted print/cartridge and tilt its front face into a predetermined initial engagement with a positioning knife edge of the printer carriage.

BRIEF DESCRIPTION OF THE DRAWINGS

The subsequent description of preferred embodiments refers to the accompanying drawings wherein:

FIG. 1 is a perspective view, with housing portions removed, of one ink jet printer apparatus which can embody the present invention;

FIG. 2 is a perspective view of one print/cartridge construction which can be precisely positioned by nest construction of the present invention;

FIG. 3 is a view of the FIG. 1 printer carriage assembly from the print zone side of the printer;

DETAILED DESCRIPTION OF PREFERRED EMBODIMENTS

Figure 6:
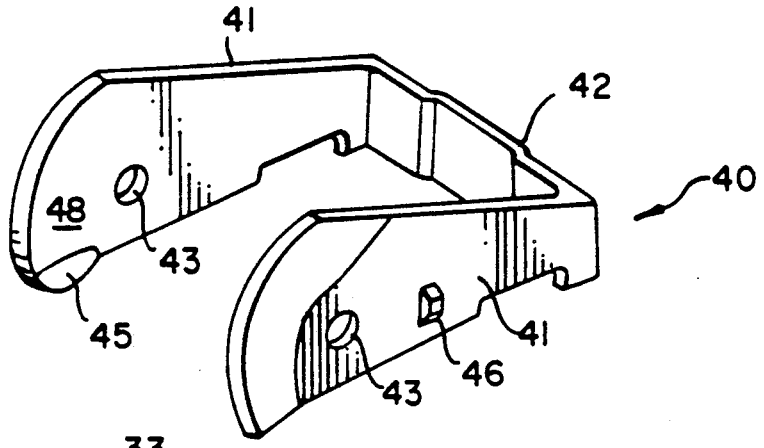
FIG. 6 is a perspective view showing a portion of the FIG. 4 nest device.

The ink jet printing apparatus shown in FIG. 1 in general comprises a print medium advancing platen 2 which is adapted to receive sheet or continuous print material from an ingress at the lower rear, and under the drive from motor 3, advance successive line portions of the medium past a print zone P, and out of the printer through a printer egress in the top of the printer. During the passage of successive line portions through the print zone, multi print/cartridge carriage 4 is traversed across the print zone so that print/cartridges placed in the four individual carriage nests 5, 6, 7 and 8 can effect printing operations. The carriage 4 is slidingly mounted on a guide rail means 35 (see FIG. 3) located beneath the print/cartridge support nests 5–8 and a carriage drive motor 9 effects traversing movement of the carriage 4, past the platen face, via an endless cable 10 attached to carriage 4. The printer is electrically energized, e.g. from a battery transformer located at 11, via a control circuit means 12. Electrical energy is supplied to individual print/cartridges by means of ribbon cables 13 which have terminals 14 in the front inner portion of each of support nests 5–8.

Referring now to FIG. 2, there is shown one useful print/cartridge embodiment 20, which is adapted to be removably inserted into an operative relation with the printer via carriage 4. The print/cartridge 20 in general comprises an ink supply reservoir 21 and cover member 22, which functions to coarsely positions the print head assembly 23 in nests 5–8. The print head assembly 23 is mounted on the cover member and comprises a driver plate 24 having a plurality of electrical leads 25 formed thereon. The leads 25 extends from connector pads 26 to resistive heater elements (not shown) located beneath each orifice 29 of a linear orifice array formed in orifice plate 27. Ink from reservoir 21 is supplied through cover member 22 to a location beneath each orifice 29 of plate 27.

The orifice plate 27 can be electroformed using photofabrication techniques to provide precisely located orifices, but thereafter it is attached to driver plate 24, which is in turn affixed to the cover member 22. Thus, it will be appreciated that even though the linear array of orifices 29 is precisely located within the orifice plate 27, its position vis a vis the locating portions of cover member 22 is not necessarily consistent for different disposable print/cartridge.

Figure 4:
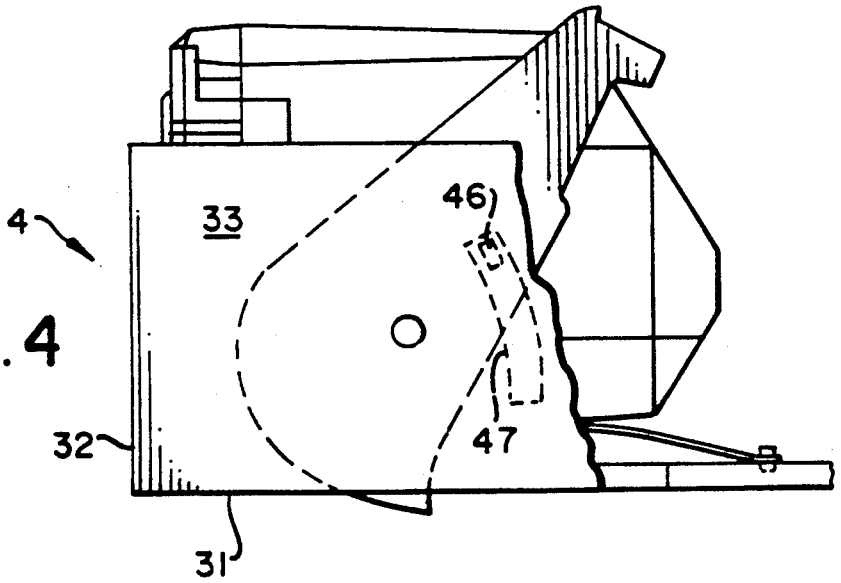
FIG. 4 is a side view, with portions broken away, of one print/cartridge and nest device in accord with the present invention.

Referring now to FIGS. 3 and 4, the print/cartridge carriage 4 comprises a bottom wall portion 31, a front wall portion 32 and side wall portions 33 which together form the plurality of print/cartridge nests 5 8 that are adapted to receive and coarsely position print/cartridges with respect to the printing zone P of the printer. The bottom of carriage 4 is mounted on the guide rail means 35 for traversing the carriage across the print zone P in a precisely uniform spacial relation to the platen 2 and in a direction substantially parallel to the axis of that platen's axis of rotation. Thus, the direction of the carriage traverse is substantially orthogonal to the direction of print medium advance.

The top of the front wall 32 of each print/cartridge nest 5–8, has, as an upper extension, knife portions 37, which form reference edges that are precisely colinear, parallel to the direction of carriage translation and equidistantly spaced from the linear print zone P. Mounted on the side walls 33 of the carriage 4 are fastening means 40 for contacting print/cartridges, which have been inserted into nests 5–8, and moving such print/cartridges so that their orifice plates are in precise interrelationship in the printer apparatus.

Figure 5:
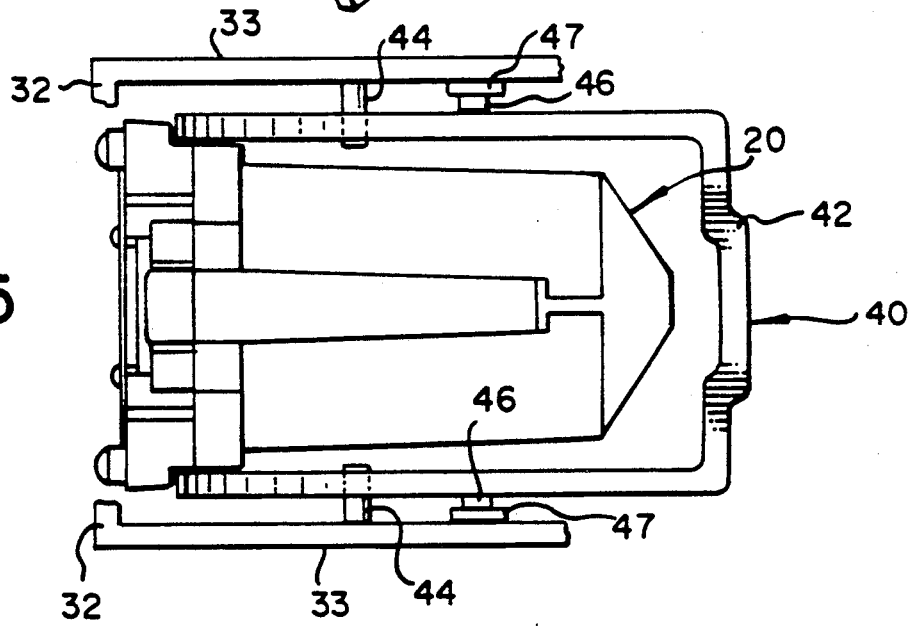
FIG. 5 is a top view of the FIG. 4 nest device in its print/cartridge insert position.

Referring now to FIGS. 4–6, it can be seen that fastening means 40 comprises a U-shaped member having arms 41 that extend from an end handle portion 42. Each arm has a central journal opening 43 adapted to ride axially on pins 44, formed on the inside of side walls 33, and thus mount the member for rotation on the pins' axis. The arms 41 are constructed so that they can be flexed toward and away from each other, so that interior surfaces 48 can slidingly pinch an inserted print/cartridge therebetween, as described subsequently. As best seen in FIG. 6, each arm 41 has a ledge portion 45 extending inwardly from its lower end and a cam follower 46 extending from its outer surface at a location to contact raised cam track portions 47, which are molded on the interior of side walls 31 (as shown in FIG. 4 and 5). The cam track is contoured from a detent edge at its lower end (as viewed in FIG. 4) to a maximum height in its central region and back to a slightly raised condition at its top region. The printer nest device also includes a cantilever spring member 49 affixed by one end to the bottom wall, with its free end biased by the spring forces to the unflexed position best shown by dotted line in FIG. 7.

Figure 7:
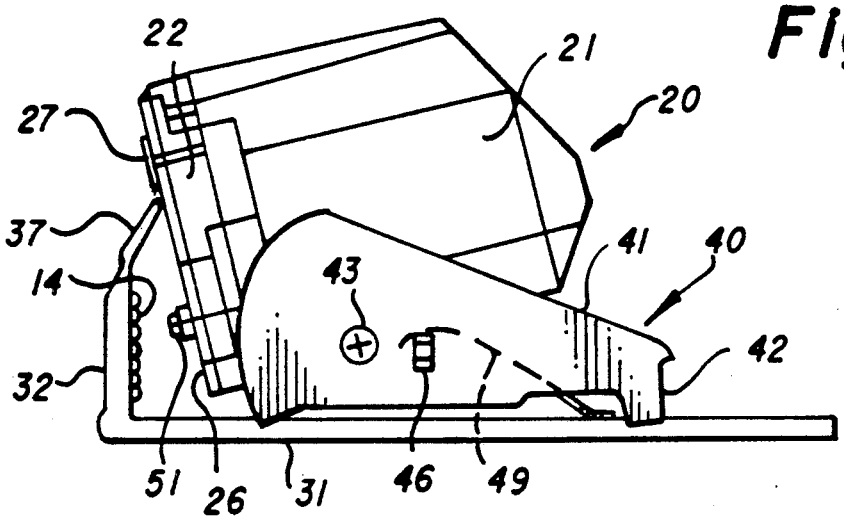
FIGS. 7–9 are side views of the FIG. 4 nest device, with side wall removed, showing successive stages of print/cartridge positioning.
Figure 8:
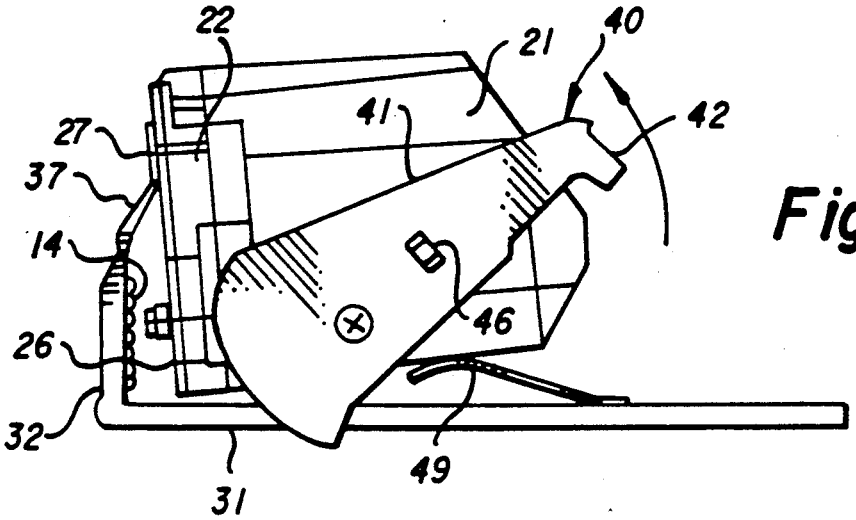
Figure 9:
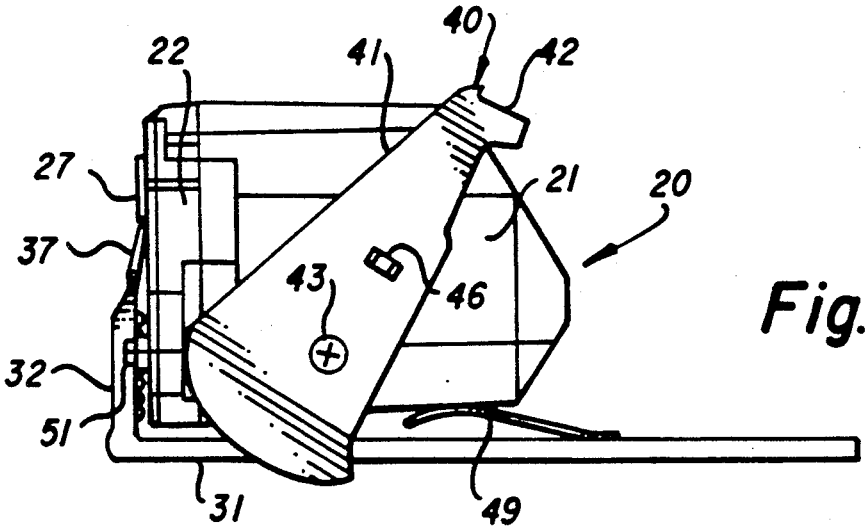

The cooperative functioning of the nest device elements can be further understood by a description of the print/cartridge insertion operation with reference to FIGS. 7–9. Thus, in FIG. 7 the fastening means 40 is shown in its "insert" orientation with the handle 42 fully downward. At this location the follower 46 is below the lower end of cam track 47 and thus detented in the insert position. When a print/cartridge 20 is dropped into the space between arms 41 it is initially positioned by three nest device constraints. That is, spring 49 supports the rear bottom of the print/cartridge to tilt it forward, ledge portions 45 support the bottom front of the print/cartridge to define the plane on which it slides toward knife edge 37 and that knife edge defines the limit to which the print/cartridge can slide downwardly. As shown in FIG. 7 these constraints are constructed so the print/cartridge reliably slides into contact with the knife edge contacting the print head surface just below the bottom of orifice plate 27.

Next. the handle 42 is raised and, as shown in FIG. 8, the surfaces 48 of arms 41 engage the lower front sides of the print/cartridge, moving its front end down and forward (to the left as shown in the Figures). More specifically, as the handle is raised, follower 46 contacts cam track 47, which causes the arm 41 to move together, sliding axially on their support pins 44. This provides a controlled pinching and sliding contact between surfaces 48 and the print/cartridge sides and moves the print/cartridge down to compress spring 49. At this stage, knife edge 37 abuts the lower index edge of orifice plate 27 and defines a pivot point about which the print/cartridge moves until its electrical contacts 26 have coupled with nest contacts 14, as shown in FIG. 9.

As noted above, the cam track 47 has a higher center region profile than at its top so that after final seating of the print/cartridge, continued handle movement upward causes the pinch force of the surfaces 48 to decrease. Preferably, the cam track-follower cooperation provides a slight holding force in the fully up position of handle 43, but one not sufficient to cause a stress that will result in a material set and loss of the arms' engagement capability. Also the over-center condition of the follower serves to retain the handle in the FIG. 9 position.

The invention has been described in detail with particular reference to certain preferred embodiments thereof, but it will be understood that variations and modifications can be effected within the spirit and scope of the invention.

What is claimed is:

1. In ink jet printing apparatus including a carriage having a plurality of nest devices and associated knife edge portions, adapted for use with insertable print/cartridges having detent portions accurately located vis a vis their orifice array, an improved nest device construction comprising:

(a) a U-shaped member having a handle and arms spaced to receive a print/cartridge therebetween and being mounted on said carriage for rotation, on an axis extending through central regions of said arms, between insert and retain positions, said arms comprising interior pinch surfaces for slidably engaging an inserted print/cartridge during rotation of said member and a bottom lip edge that extends inwardly to initially support a print/cartridge in an insert position; and (b) spring means located between the arms of said member for contacting the bottom rear surface of an inserted print cartridge and tilting its front face into engagement with associated knife edge portion.

2. The invention defined in claim 1 wherein said U-shaped member includes cam follower means formed on exterior surfaces of said arms and wherein said carriage includes a cam track located to engage said follower means during movement of said member and effect:

(i) a non-compressed condition of said arms at an insert position of said member;

(ii) a slightly compressed condition of said arms at a retention position; and (iii) more highly compressed conditions during movement of said arm between said insert and retention positions.

3. The invention defined in claim 1 wherein said member includes ledge means for supporting an inserted print/cartridge in a predetermined plane vis a vis said knife edge portions.

4. In ink jet printing apparatus including a plurality of nest devices and associated knife edge portions, adapted for use with insertable print/cartridges having portions accurately located vis a vis their orifice array, an improved nest device construction comprising:

(a) a receiving member having two arms spaced to receive a print/cartridge and being mounted on said carriage for rotation, between insert and retain positions, said arms comprising interior ledge portions for slidably supporting an inserted print/cartridge in the insert position of said member; and (b) spring means located between the arms of said member operable in the insert position of said member for contacting the bottom rear surface of an inserted print/cartridge and tilting an inserted print/cartridge so that its front face slides on said associated knife edge portion into engagement with said detent portion.

5. The invention defined in claim 4 wherein said member includes cam follower means formed on exterior surfaces of said arms and wherein said nest devices include a cam track located to engage said follower means during movement of said member and effect;

(i) a non-compressed condition of said arms at an insert position of said member;

(ii) a slightly compressed condition of said arms at a retention position; and (iii) more highly compressed conditions during movement of said arm between said insert and retention positions.

* * * * *